United States Patent [19]

Weisenbarger et al.

[11] Patent Number: 4,711,271

[45] Date of Patent: Dec. 8, 1987

[54] MAGNETIC FLUID CONDITIONER

[76] Inventors: Gale M. Weisenbarger, 140 Woodland Dr., Eaton, Ohio 45320; John C. Moran, 3124 Lake Ave., Fort Wayne, Ind. 46805

[21] Appl. No.: 942,003

[22] Filed: Dec. 15, 1986

[51] Int. Cl.[4] ..... F15C 1/04

[52] U.S. Cl. ..... 137/827; 137/807; 123/538; 210/222

[58] Field of Search ..... 210/222, 695; 123/536–539; 137/803, 827, 807

[56] References Cited

U.S. PATENT DOCUMENTS

| | | | |
|---|---|---|---|
| 4,188,296 | 2/1980 | Fujita | 210/222 |
| 4,265,754 | 5/1981 | Merold | 210/222 |
| 4,265,755 | 5/1981 | Zimmerman | 210/222 |
| 4,422,429 | 11/1983 | Reed | 123/538 |
| 4,605,498 | 8/1986 | Kulish | 210/222 |

FOREIGN PATENT DOCUMENTS

| | | | |
|---|---|---|---|
| 1155086 | 11/1983 | Canada | 210/222 |
| WO84/03539 | 9/1984 | PCT Int'l Appl. | 123/538 |

*Primary Examiner*—A. Michael Chambers
*Attorney, Agent, or Firm*—Louis E. Hay

[57] ABSTRACT

A magnetic fluid conditioner for abating the adherence of precipitates in conduits transmitting a variety of fluids and/or gases which contain unwanted compounds which will precipitate and adhere to the inner walls of the conduits. The magnetic fluid conditioner includes a metallic flux path for increasing the flux density.

12 Claims, 15 Drawing Figures

MAGNETIC FLUID CONDITIONER

BACKGROUND OF THE INVENTION

Although the specific reasons therefor are not fully understood, it has long been known that magnetic devices will produce a beneficial effect on many fluids, including gas. For example, placing a magnetic device on the fuel line between the fuel pump and the carburetor on an internal combustion engine, such as is used in an automobile or a tractor, will improve engine performance and will also produce a cleaner exhaust emission.

Another example, the placing of magnetic devices on pipes transmitting crude oil will substantially decrease the buildup of paraffin on the interior of the pipes.

The best known example, because it affects every household to some degree, is the incrustation of calcium salts and other compounds in water transmitting installations. After there is sufficient detrimental buildup in the pipes, it becomes necessary to replace the pipes because there is no way of removing the incrustation. The best solution is to prevent the incrustation by magnetically acting on the offending compounds and causing them to be discharged in the flowing water.

A review of the art reveals numerous magnetic devices which have been produced, some of which are obviously more effective than others.

SUMMARY OF THE INVENTION

The primary objective of the present invention is to increase the efficiency of a given size magnetic device. This has been accomplished by increasing the magnetic effectiveness by using a configuration not taught in any of the art known to the applicants. A review of the specification, including the drawings, will show that this is accomplished by providing a more effective flux path.

While the invention will be described in connection with a water treatment problem, it will be understood that it is not intended to limit the invention to such embodiment. On the contrary, it is intended to cover all alternatives, modifications and equivalents as may be included within the spirit and scope of the invention as defined in the appended claims.

DESCRIPTION OF THE PREFERRED EMBODIMENT

Figure 1:
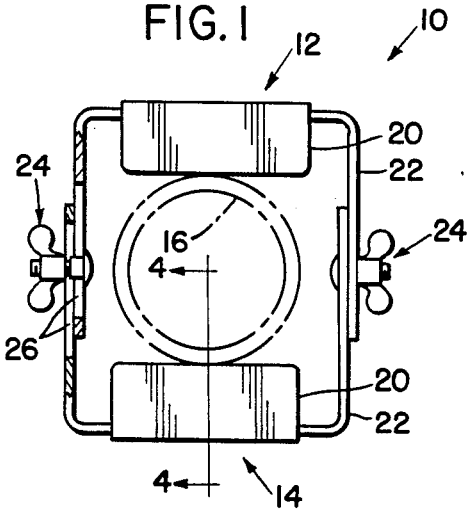
FIG. 1 depicts a first embodiment of the magnetic device positioned on a conduit or tube shown in phantom cross-section.
Figure 2:
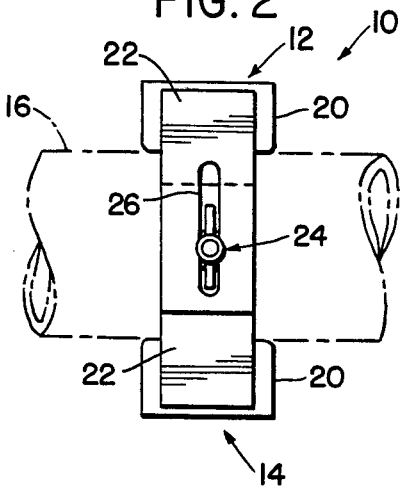
FIG. 2 is a right side elevational view of FIG. 1.

The magnetic fluid conditioner 10 has two substantially identical magnetic units, an upper magnetic unit 12 and a lower magnetic unit 14 which is used in combination with the magnetic unit 12. As will be described below, the two magnetic units 12 and 14 may be identical if the polarity of the permanent magnets therein are positioned to be in the same direction in relationship with the other elements constituting the magnetic units. As depicted in FIGS. 1 and 2, the magnetic fluid conditioner 10 is externally installed onto a fluid transmitting conduit 16, shown in phantom, and which does not constitute an element of the first embodiment of the invention.

Figure 3:
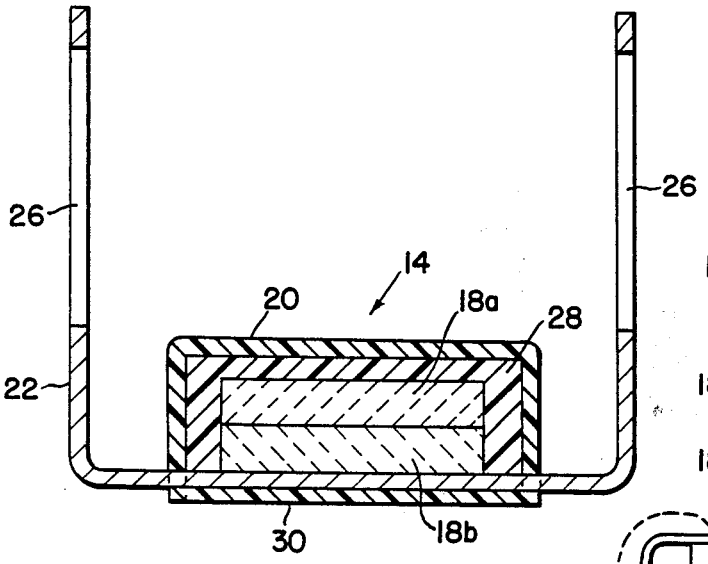
FIG. 3 is an enlarged longitudinal cross-section through the lower magnetic unit of FIG. 1.
Figure 4:
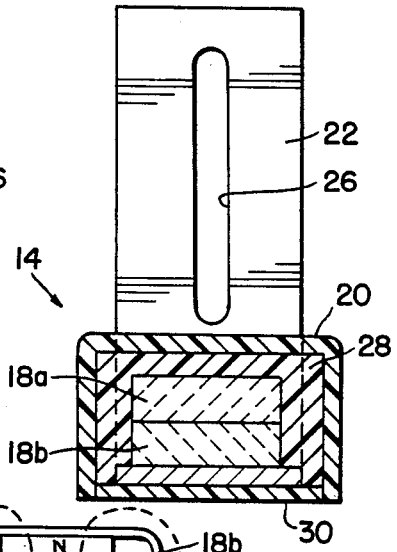
FIG. 4 is an enlarged transverse cross-section taken on line 4—4 of FIG. 1.

The internal construction of the magnetic units is depicted in FIGS. 3 and 4. Although one magnet would suffice for purposes of illustration, applicants have used two elongated bar magnets **18*a* and 18*b*. Within the scope of the invention, other magnets may be used, as for example, the magnets may be of square shape or of circular disc shape. The elongated bar magnets are retained within an elongated housing 20 which is somewhat longer, wider and deeper than the magnets. The housing 20 may be described as an elongated box structure having a closed bottom and an open side opposite thereto. The housing may be made from any convenient non-magnetic material such as aluminum or plastic. As viewed in FIG. 3, the open side of the housing is directly adjacent to the U-shaped clamp member 22. The clamp member 22 on the lower magnetic unit 14, when used in combination with a like or similar clamp member 22 on the upper magnetic unit 12, provides a convenient method for retaining the magnetic fluid conditioner 10 on the fluid conducting conduit 16 as depicted in FIGS. 1 and 2 by means of two bolts with wing nuts 24. The parallel side elements of the clamp members provide overlapping engagement and are each provided with elongated slots 26 as a convenient adjustment permitting the magnetic fluid conditioner 10 to be installed on several sizes of fluid transmitting conduits 16**.

Other well known means may be used to retain the two magnetic units in mounted position. For example, screws which pass through slots in one clamp and screw into threaded apertures in the other clamp may be used.

Although the U-shaped clamp members provide a convenient method for mounting the fluid conditioners onto conduits, their primary purpose is to provide a continuous and uninterrupted metallic flux flow path. Accordingly, the clamp members 22 must be made of a metallic material. A very suitable material is ordinary strap iron which is well known in many arts.

As best depicted in FIG. 3, opposing open sides of the housing 20 are notched to receive the clamp. The magnets are preferably positioned to be directly against the clamp when the clamp is positioned in the housing. The magnets and the clamp are retained in assembled relationship by means of well known dielectric potting material 28.

Although, within the scope of the invention, it is not necessary that the magnets are directly against the clamps, the greatest flux density is secured when the magnets are directly against the clamps.

As depicted in FIG. 3, the notches in the housing 20 are somewhat deeper than the thickness of the clamps. After assembly, the open end of the housing may be closed with a cover 30 to present a neat appearance.

It is obvious that the clamps may be installed to be transverse with the magnets instead of longitudinal as depicted. This would permit the bar magnets to be longitudinal with the conduit on which the magnetic fluid conditioner is installed.

Figure 5:
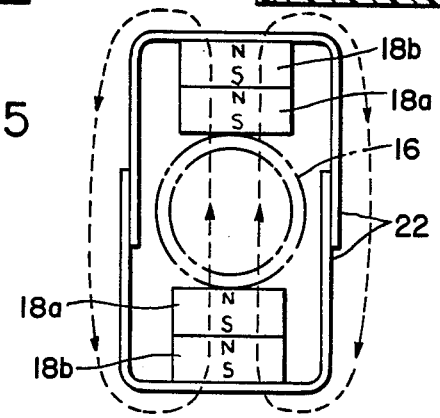
FIG. 5 is a schematic of the structure depicted in FIG. 1 and showing the permanent magnets and the flux paths.
Figure 6:
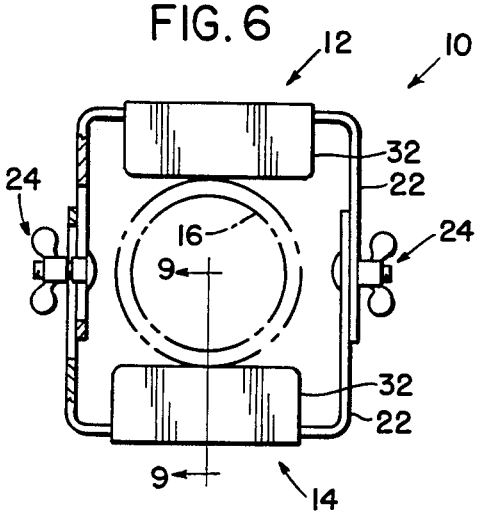
FIG. 6 is comparable with FIG. 1 except for a different internal construction which is described below.
Figure 7:
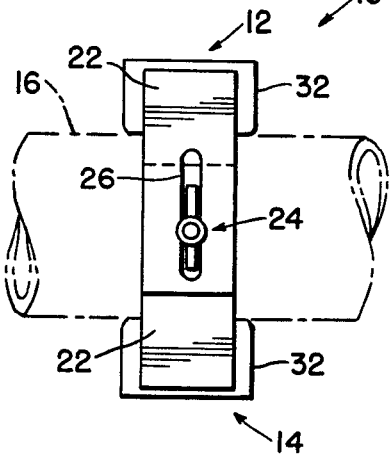
FIG. 7 is comparable with FIG. 2 and is a right side elevational view of FIG. 6.
Figure 8:
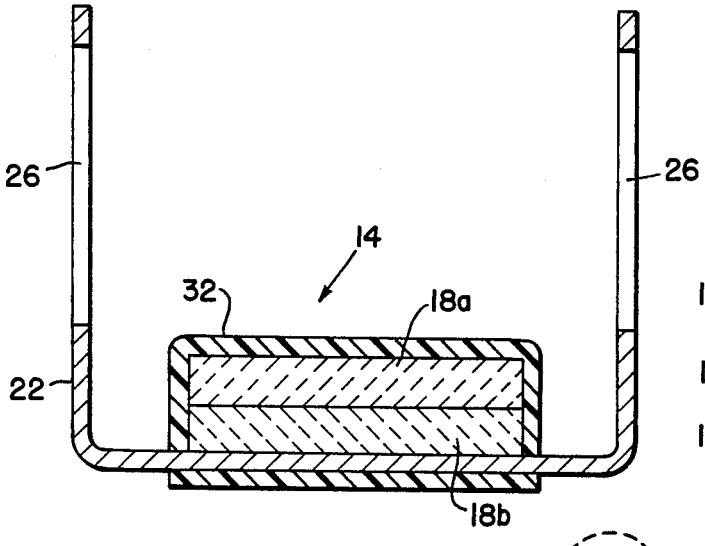
FIG. 8 is an enlarged longitudinal cross-section taken through the lower magnetic unit of FIG. 6.
Figure 9:
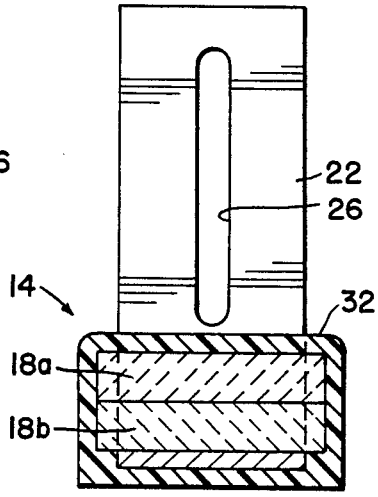
FIG. 9 is an enlarged transverse cross-section taken on line 9—9 of FIG. 6.
Figure 10:
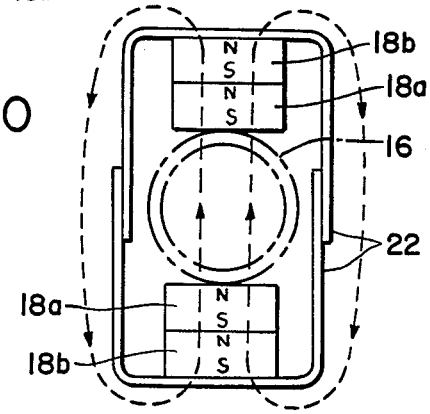
FIG. 10 is a schematic of the structure depicted in FIG. 6 and showing the permanent magnets and the flux paths.

With the polarity of the magnets as indicated in the schematic FIG. 5, the flux path is as indicated.

Although the clamps are made to be integral with the other elements of the magnetic units as depicted, they may be made to be detachable. By doing so, the clamps may be sized to fit the particular fluid conducting conduit on which the magnetic fluid conditioner is to be installed.

A variation of the magnetic fluid conditioner shown in FIGS. 1–5 is depicted in FIGS. 6–10. The only difference is that the housing 20 and cover 30 are not used. Instead, the magnets 18*a* and 18*b*, and the clamp 22 are held in assembled relationship by potting material 32. The flux flow paths of the two designs are identical as seen in the schematic FIGS. 5 and 10.

Actual tests were conducted to determine the increase in magnetic efficiency when the magnetic clamps 22 were added to magnetic units which were otherwise identical in all respects. The increase in the Gauss readings were about 25 percent. The tests were conducted on both $\frac{5}{8}$ inch and $\frac{7}{8}$ inch plastic tubing. The measurements were taken at the center of the tubing with a LDJ Digital Gaussmeter, Model 101–B.

The readings were as follows:

Without magnetic clamps.

$\frac{5}{8}$ inch O.D. tubing: 1460 Gauss $\frac{7}{8}$ inch O.D. tubing: 1210 Gauss With magnetic clamps as depicted.

$\frac{5}{8}$ inch O.D. tubing: 1820 Gauss $\frac{7}{8}$ inch O.D. tubing: 1500 Gauss A second embodiment of the invention is depicted in FIGS. 11–15. Whereas the first embodiment (FIGS. 1–10) is primarily used for external detachable installations on existing conduits, the second embodiment is primarily used on new installations, and installations where it is desired that the magnetic fluid conditioners are not readily detachable.

This is accomplished by building the magnetic fluid conditioner as a unitary structure through which the fluid transmitting conduit passes. The magnetic conditioner cannot be removed without disassembly of a portion of the conduit system in which the conditioner is installed.

The magnetic fluid conditioner 50, the construction of which is most clearly depicted in FIGS. 12–15, has a non-magnetic housing 52 similar to the housing 20 of the first embodiment.

Figure 11:
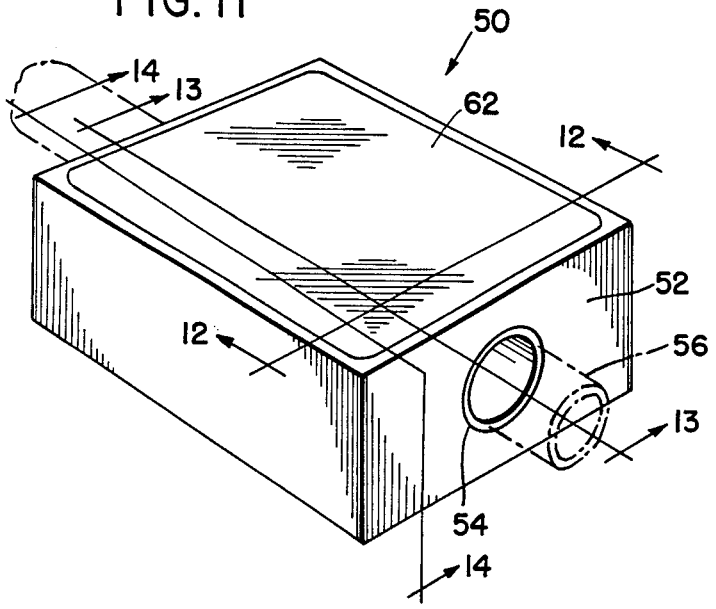
FIG. 11 is a perspective of a second embodiment of the invention.
Figure 12:
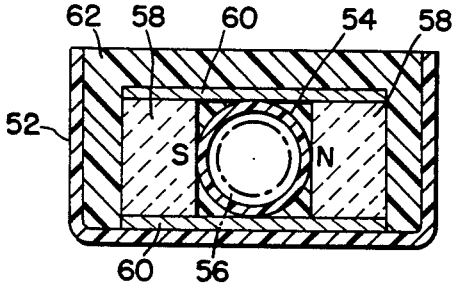
FIG. 12 is a vertical transverse cross-section taken along line 12—12 on FIG. 11.
Figure 13:
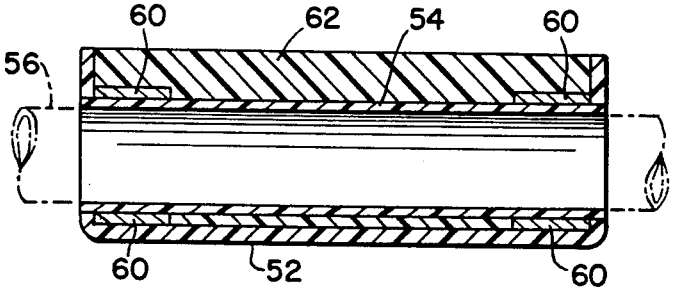
FIG. 13 is a vertical longitudinal cross-section taken along line 13—13 on FIG. 11.

Opposing ends of the housing have an aperture for receiving a sleeve 54 as depicted in FIGS. 11–13. The inside diameter of the sleeve 54 is such as will slidably receive on installation, a fluid carrying conduit 56, shown in phantom, which does not constitute an element of this species of the invention.

Within the housing 52 are a pair of elongated permanent bar magnets 58 longitudinally positioned along the sleeve 54 on opposing sides thereof as shown in FIG. 12. Within the scope of the invention, single magnets may be used as depicted in FIG. 12, or, in the alternative, a plurality of magnets may be used as depicted in FIGS. 3, 4, 8 and 9.

Figure 15:
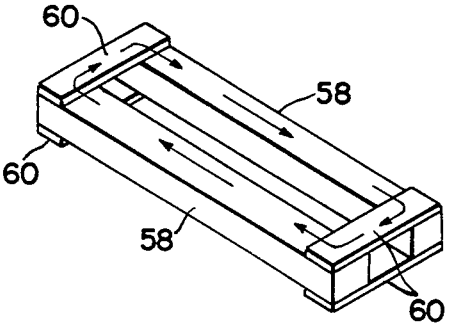

Whereas in the first embodiment of the invention, U-shaped clamp elements 22 were used to provide a continuous flux path, the second embodiment uses a plurality of pole pieces 60 which are most clearly shown in the schematic sketch FIG. 15. The pole pieces 60 may be made of well known strap iron. The flux path of the combination of bar magnets 58 and pole pieces 60 is depicted in FIG. 15.

After the sleeve 54, bar magnets 58 and pole pieces 60 are positioned within the housing 52, the housing is poured with well known dielectric potting material 62.

Figure 14:
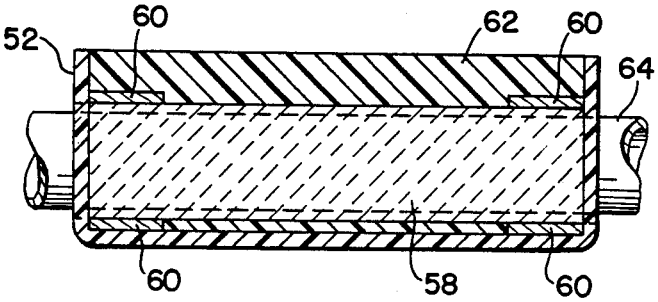
FIG. 14 is a vertical longitudinal cross-section taken on line 14—14 on FIG. 11, and, FIG. 15 is a schematic of the structure depicted on FIG. 11 and showing the permanent magnets and flux paths.

A variation of the second embodiment is depicted in FIG. 14. In this variation, the sleeve 54 is omitted, and a length of pipe or tubing 64 is embedded. Element 64 may be an ordinary threaded pipe nipple or a length of tubing, for example. When the magnetic fluid conditioner 50 has this configuration, it is installed in series in the fluid transmitting conduit where it will be considered to be a permanent installation.

It is to be understood that the embodiments of the present invention as shown and described are to be regarded merely as illustrative, and that the invention is susceptible to variations, modifications and changes, without regard to construction methods within the scope of the appended claims.

We claim:

1. A magnetic fluid conditioner for acting on a fluid being transmitted through a conduit, said fluid conditioner comprising:

(a) a housing having an open top side and a closed bottom side and closed ends, the closed ends each having an aperture therethrough in co-axial alignment;

(b) an elongated conduit passing through the apertures in the ends of said housing and extending from both ends thereof;

(c) at least two permanent bar magnets in said housing positioned in opposition at the periphery of said conduit, and with a pole on each magnet positioned along said conduit being directly adjacent to the periphery of said conduit; and, (d) a plurality of magnetic metallic pole pieces bridging the magnets on opposing sides of said conduit to provide a metallic flux path between said magnets; said conduit, magnets, and pole pieces being retained in fixed relationship within said housing.

2. A magnetic fluid conditioner in accordance with claim 1 in which said conduit is a pipe.

3. A magnetic fluid conditioner in accordance with claim 1 in which said conduit is a metal tube.

4. A magnetic fluid conditioner in accordance with claim 1 in which said magnets are elongated bar magnets positioned to be parallel with said conduit.

5. A magnetic fluid conditioner for acting on a fluid being transmitted through a conduit, said fluid conditioner comprising:

(a) a housing having an open top side and a closed bottom side and closed ends, the closed ends each having an aperture therethrough in co-axial alignment;

(b) an elongated sleeve supported by the apertures in the ends of said housing, the inside diameter of said sleeve being such as will receive said fluid transmitting conduit passing through said sleeve;

(c) at least two permanent bar magnets in said housing positioned in opposition at the periphery of said sleeve, and with a pole on each magnet positioned along said sleeve being directly adjacent to the periphery of said sleeve; and, (d) a plurality of magnetic metallic pole pieces bridging the magnets on opposing sides of said sleeve to provide a metallic flux path between said magnets; said sleeve, magnets, and pole pieces being retained in fixed relationship within said housing.

6. A magnetic fluid conditioner in accordance with claim 5 in which said magnets are elongated bar magnets positioned to be parallel with said sleeve.

7. A magnetic fluid conditioner for acting on a fluid being transmitted through a conduit, said fluid conditioner having magnetic units used in pairs, each pair comprising:

(a) a first magnetic unit having a housing with an open side and a closed side opposite thereto, at least one permanent magnet retained within said housing, and a U-shaped magnetic metallic clamp positioned at the open side of said housing and with the opposing side elements of said clamp extending in the direction of the closed side of said housing; and, (b) a second magnetic unit having a housing with an open side and a closed side opposite thereto, at least one permanent magnet retained within said housing, and a U-shaped magnetic metallic clamp positioned at the open side of said housing and with the opposing side elements of said clamp extending in the direction of the closed side of said housing, the opposing side elements of the clamp on said magnetic unit making engagement with the opposing side elements of the clamp on said first magnetic unit when the two magnetic units constituting said magnetic fluid conditioner are installed on said fluid transmitting conduit with the closed side of said housings adjacent to said fluid transmitting conduit, the side elements of the two U-shaped clamps forming a continuous metallic flux path between the magnets in said first and said second magnetic units.

8. A magnetic fluid conditioner in accordance with claim 7 in which the U-shaped clamps on said first and said second magnetic units are affixed to the housing of said magnetic units.

9. A magnetic fluid conditioner in accordance with claim 7 in which the U-shaped clamps on said first and said second magnetic units are detachable from the housing of said magnetic units.

10. A magnetic fluid conditioner in accordance with claim 7 in which said permanent magnets are rectangular bar magnets.

11. A magnetic fluid conditioner in accordance with claim 7 in which the magnet faces adjacent to the open side of said housings are of opposite polarity.

12. A magnetic fluid conditioner in accordance with claim 7 in which the magnet in each of said magnetic units makes direct contact with said U-shaped clamp thereon.

* * * * *